US008096003B2

(12) United States Patent
Schuster

(10) Patent No.: US 8,096,003 B2
(45) Date of Patent: Jan. 17, 2012

(54) TRANSPORTING DEVICE FOR PATIENTS

(75) Inventor: Jürg O. Schuster, Zumikon (CH)

(73) Assignee: SAMARIT Medical Industries Inc., Cambridge, Ontario (CA)

( * ) Notice: Subject to any disclaimer, the term of this patent is extended or adjusted under 35 U.S.C. 154(b) by 118 days.

(21) Appl. No.: 12/579,042

(22) Filed: Oct. 14, 2009

(65) Prior Publication Data

US 2010/0101019 A1 Apr. 29, 2010

(30) Foreign Application Priority Data

Oct. 23, 2008 (DE) ..... 10 2008 052 968

(51) Int. Cl.
*A61G 1/003* (2006.01)

(52) U.S. Cl. ..... 5/81.1 C; 5/81.1 HS; 5/627

(58) Field of Classification Search ..... 5/81.1 C, 5/81.1 HS, 81.1 R, 627, 926; 414/921; 193/35 F
See application file for complete search history.

(56) References Cited

U.S. PATENT DOCUMENTS

| | | | | |
|---|---|---|---|---|
| 4,051,565 | A * | 10/1977 | Berge | 5/81.1 R |
| 4,297,753 | A * | 11/1981 | Langren | 5/81.1 C |
| 4,944,053 | A * | 7/1990 | Smith | 5/81.1 T |
| 5,934,282 | A * | 8/1999 | Young et al. | 128/870 |
| 5,966,754 | A * | 10/1999 | Schuster | 5/81.1 R |
| 6,374,435 | B1 * | 4/2002 | Leininger et al. | 5/81.1 HS |
| 6,698,041 | B2 * | 3/2004 | VanSteenburg et al. | 5/81.1 R |
| 7,020,912 | B2 * | 4/2006 | Berge | 5/81.1 HS |
| 7,650,654 | B2 * | 1/2010 | Lambarth et al. | 5/81.1 HS |

FOREIGN PATENT DOCUMENTS

| | | | |
|---|---|---|---|
| DE | 3814972 | C1 | 5/1989 |
| DE | 3806470 | A1 | 9/1989 |
| DE | 3806470 | C2 | 5/1991 |
| DE | 195 12 008 | C1 | 11/1996 |
| DE | 10224270 | B3 | 10/2003 |
| DE | 10334270 | B3 | 11/2004 |
| DM | 011933 | | 10/1988 |
| EP | 0 340 450 | B1 | 1/1992 |

* cited by examiner

*Primary Examiner* — Michael Trettel
(74) *Attorney, Agent, or Firm* — Priest & Goldstein, PLLC

(57) ABSTRACT

The invention relates to a transporting device for patients who are to be transported from a first site to a second site using low force. For this purpose is provided a firm board which can also be resilient, wherein this board is encompassed by an endless band. This endless band is adapted to the shape of the board and can slide around the board. The outer ends of the board are provided with caps which, on the one hand, lend the board high rigidity at the ends and, on the other hand, prevent body fluids from penetrating into the interspace between board and endless band.

17 Claims, 8 Drawing Sheets

TRANSPORTING DEVICE FOR PATIENTS

Figure 1A:
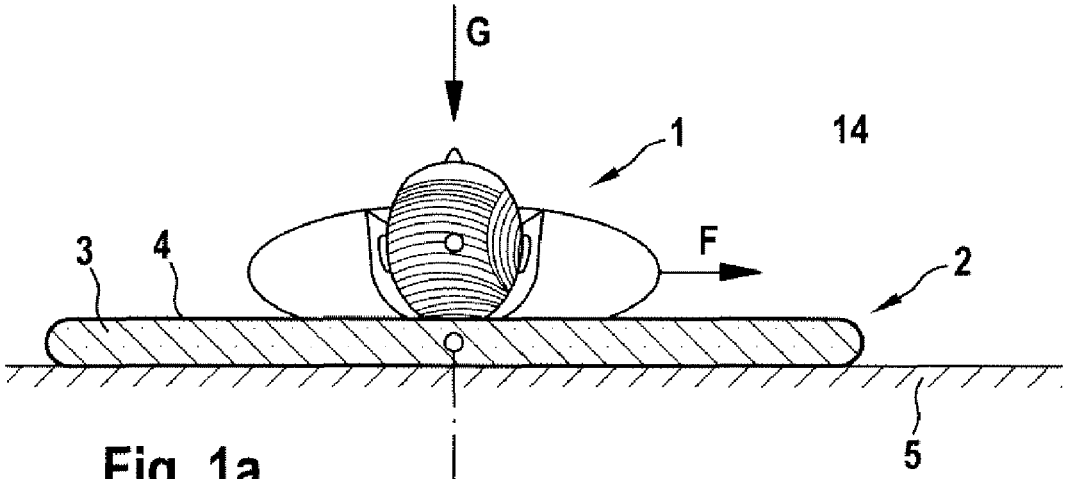

The invention relates to a transporting device according to the preamble of patent claim 1.

There is often a need in clinics or for in-home care of patients to transport the patient from one place to another without the patient contributing to this transfer on his own. Such a transport takes place, for example, from a first bed to a second bed located next to it.

A transporting device for patients is already known which is portable and with which it is possible for physically weak persons to move even heavy-weight patients from one bed into another (DE 38 06 470 C2). In this transporting device an endless band is wrapped about a board, wherein the cross sectional circumference of the board corresponds substantially to the cross sectional circumference of the endless band. The frictional resistance between the endless band and the board is herein so low that it can be overcome by an operating person pulling on the endless band if a person is located thereon. The superjacent surfaces of the endless band and of the board can be comprised of polypropylene band fabric. As the board a relatively rigid expanded material mat can, in addition, be provided. One disadvantage of this transporting device comprises that it is unwieldy and is not foldable.

There is furthermore known a transporting device for patients, which can be more easily carried. (International Design Patent DM/011933). This transporting device includes handholds at its narrow side and is foldable at its center.

In another known transporting device for patients, instead of a board, a section of rolling shutter is provided (DE 103 34 270 B3). Hereby the transporting device can be rolled up.

The invention addresses the problem of providing a transporting device of the generic type in which two opposing ends are provided with security means.

This problem is resolved according to the features of claim 1.

The invention, consequently, relates to a transporting device for patients who are to be transported using low force from a first location to a second location. For this purpose a firm board is provided, which can also be resilient, this board being encompassed by an endless band. This endless band is adapted to the shape of the board and can slide around the board. The outer ends of the board are provided with caps, which, on the one hand, lend the board high rigidity at the ends and, on the other hand, prevent body fluids from penetrating into the interspace between board and endless band.

An advantage attained with the invention comprises that through the security means, transport, for example from one bed to another bed, is even possible if there is a gap between the two beds for the caps provided at the ends are highly dimensionally stable. Since the caps extend under the endless band, it is, moreover, prevented that body fluids from the sides, i.e. where the caps are located, penetrate immediately onto the top side of the board or onto the sheet placed over the board.

Figure 1B:
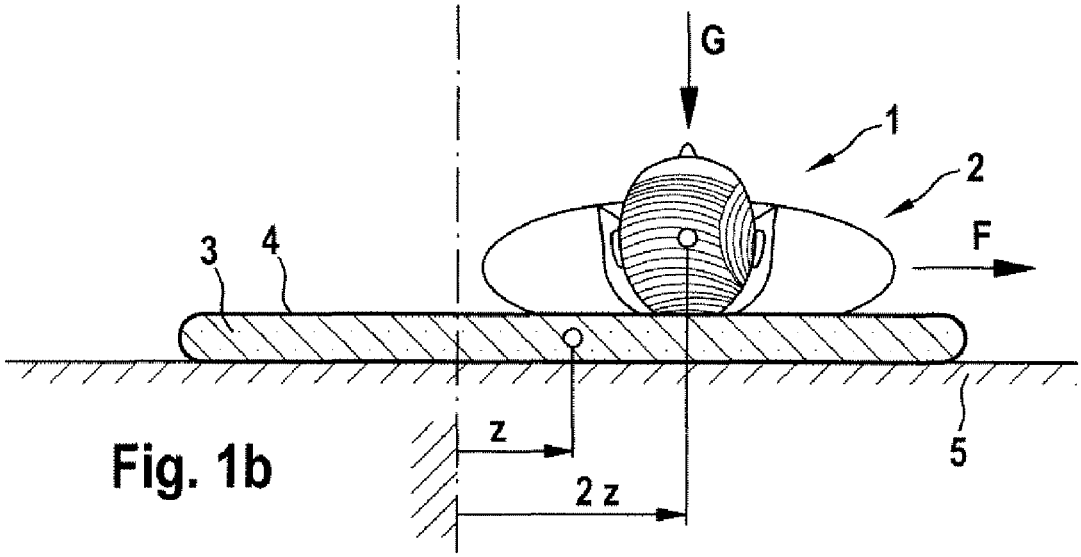
Figure 2:
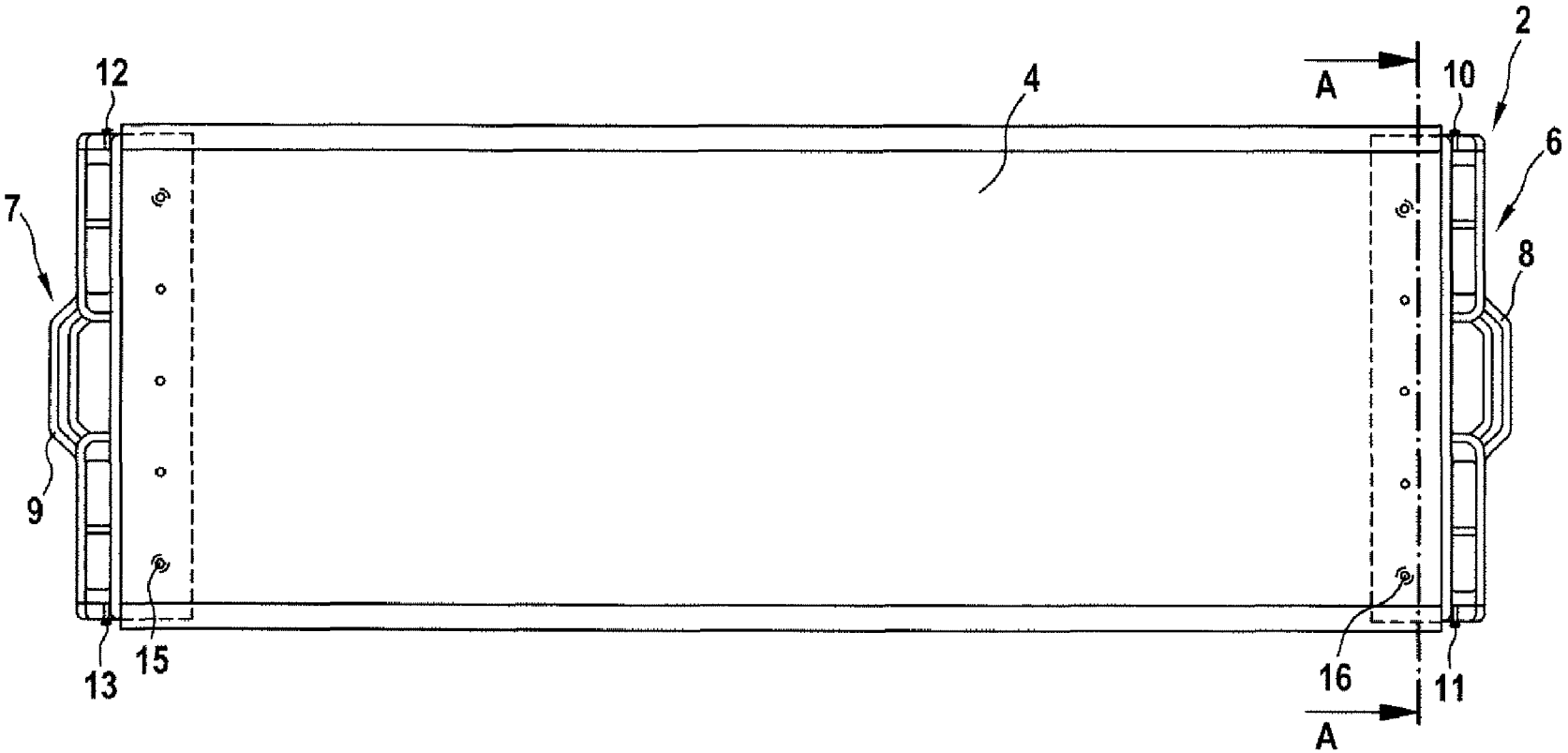
Figure 3:
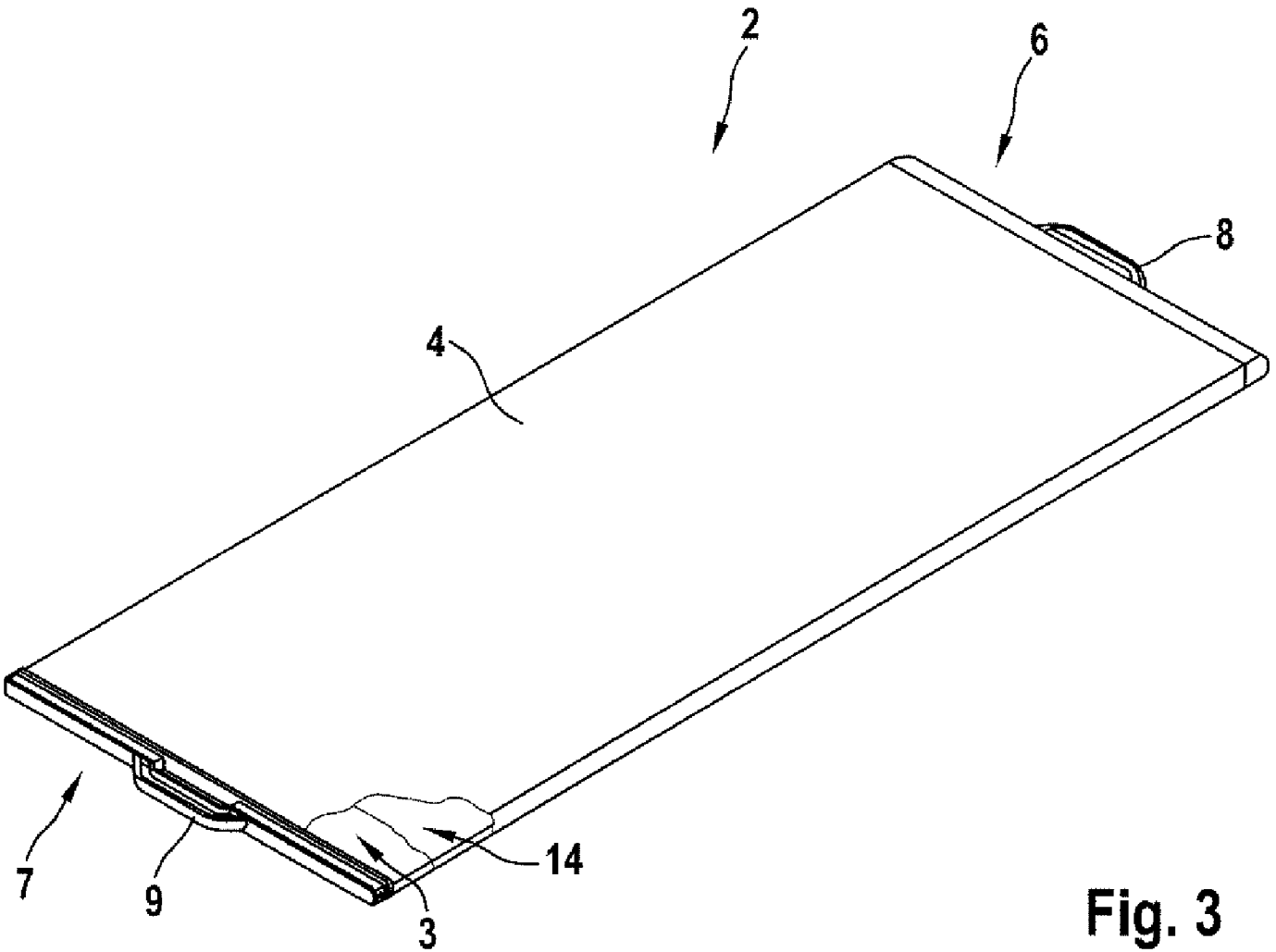
Figure 4:
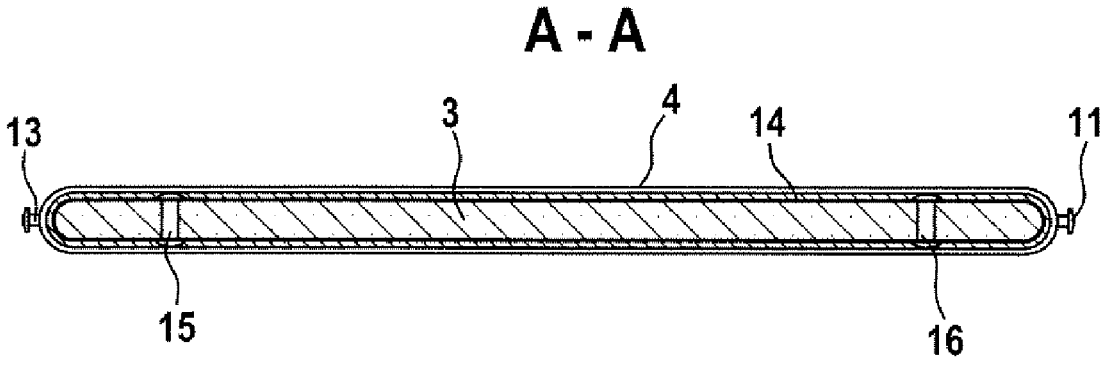
Figure 5:
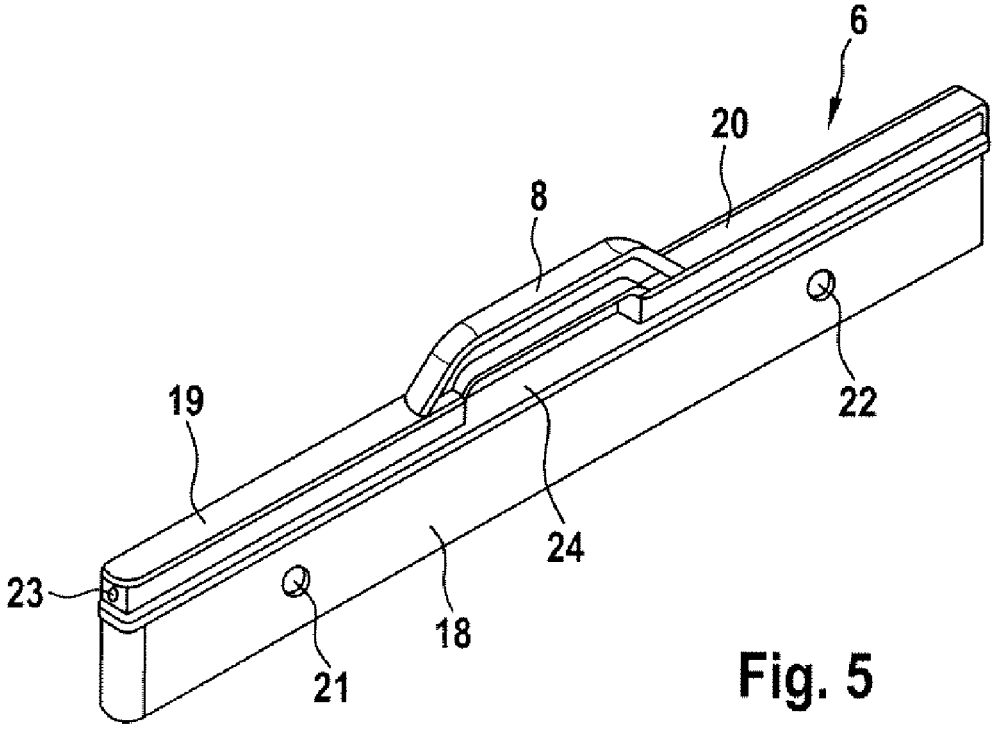
Figure 6:
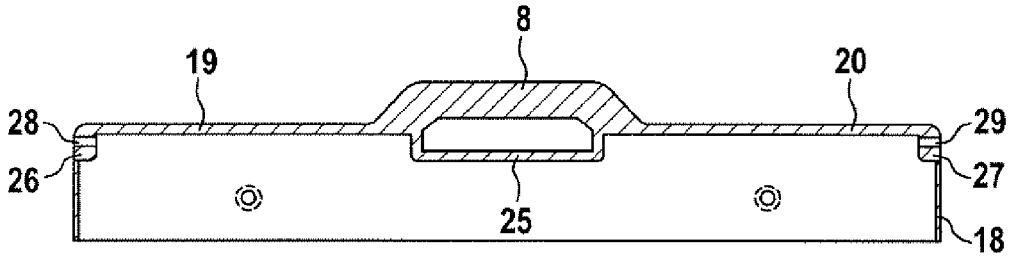
Figure 7:
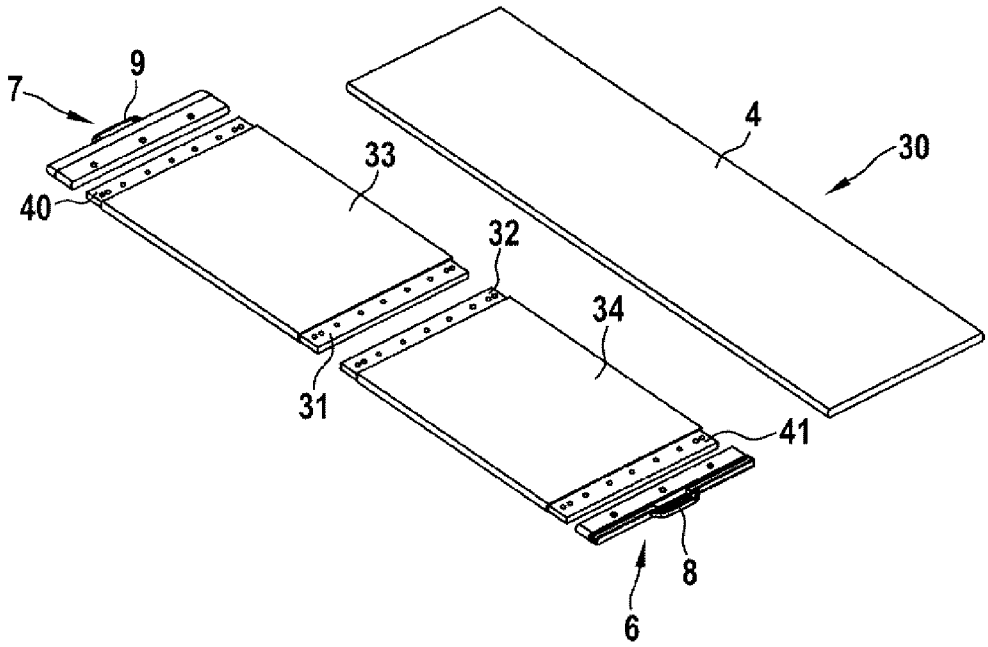
Figure 7A:
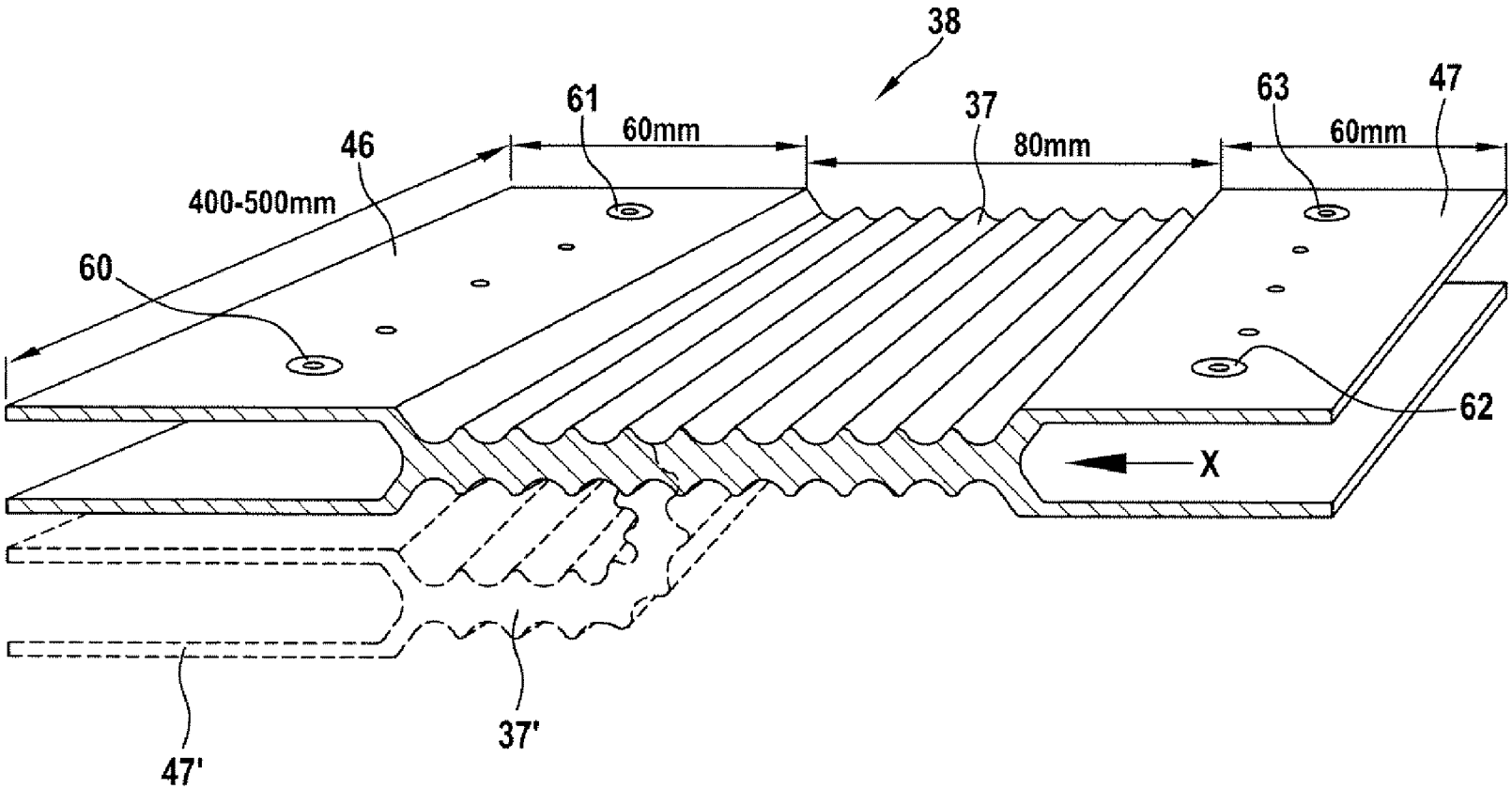
Figure 8:
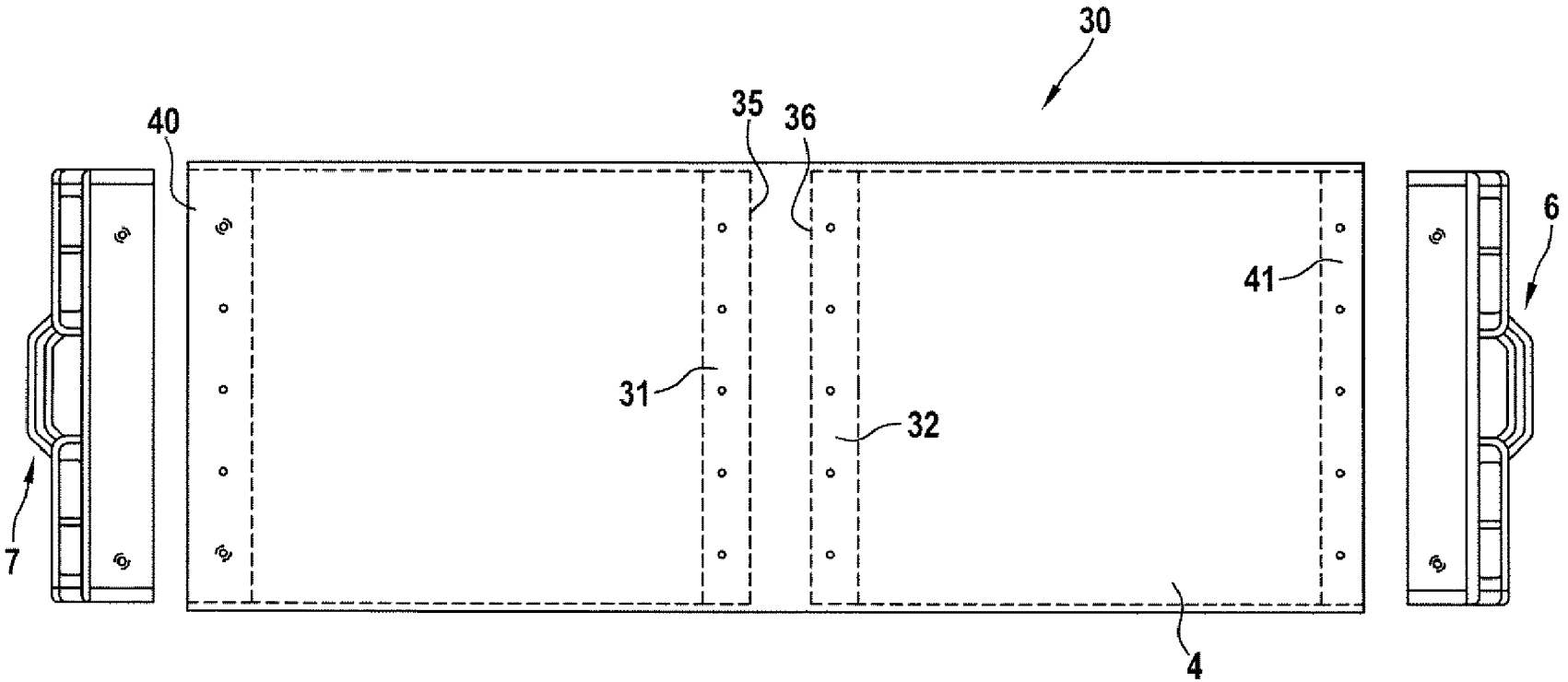
Figure 9:
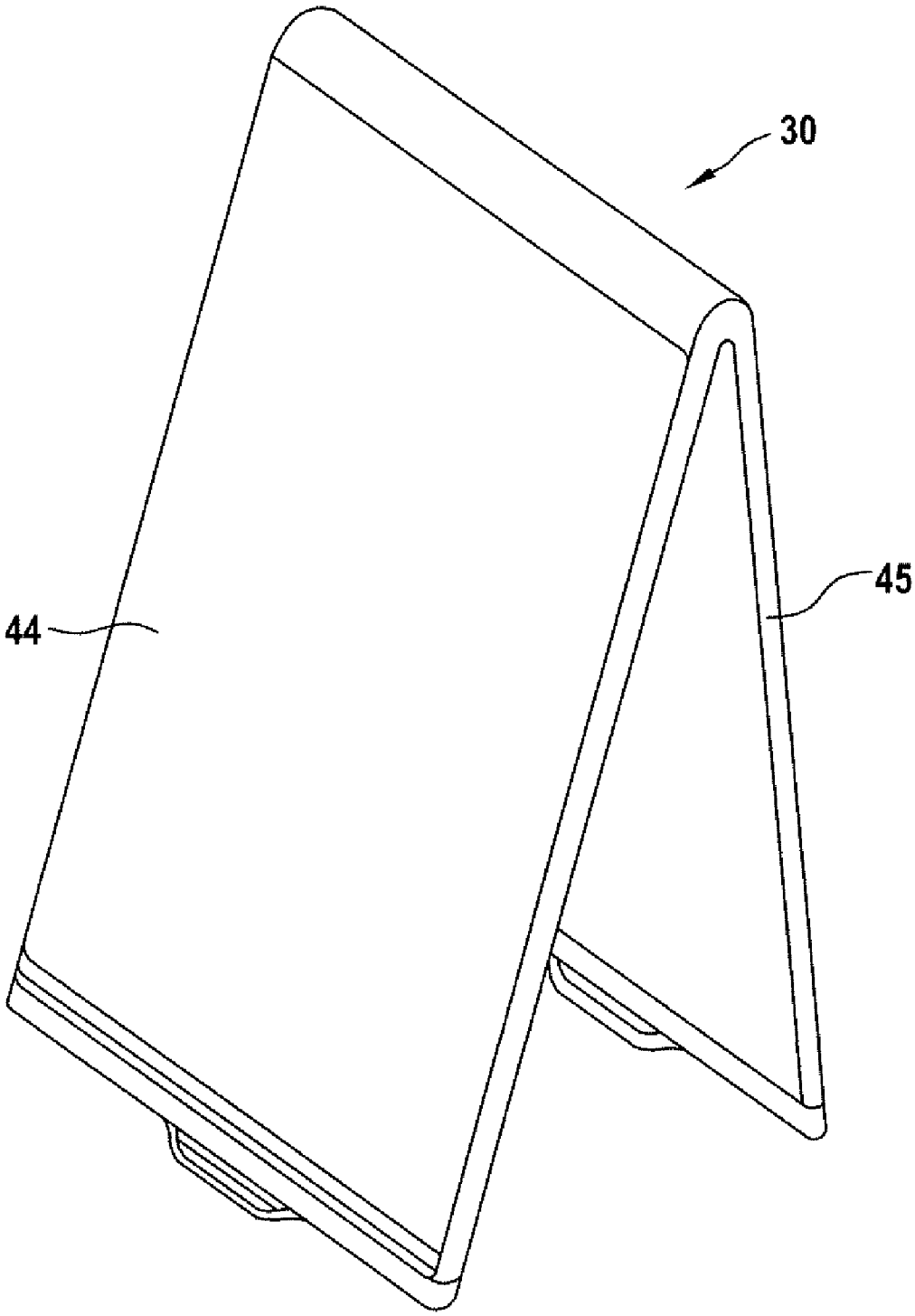

An embodiment example of the invention is shown in the drawings and will be described in the following in further detail. In the drawings depict:

FIG. 1*a* a patient on a transporting device in a first position,

FIG. 1*b* a patient on a transporting device in a second position,

FIG. 2 a top view onto a transporting device according to the invention,

FIG. 3 a perspective representation of the transporting device shown in FIG. 2, FIG. 4 a section A-A through the transporting device shown in FIG. 2, FIG. 5 a perspective view onto a cap with handhold, FIG. 6 a longitudinal section through the cap according to FIG. 5, FIG. 7 a variant of the transporting device according to the invention in the disassembled state, FIG. 7*a* an elastic connection between two boards, FIG. 8 the variant according to FIG. 7 in the partially assembled state, FIG. 9 the variant according to FIG. 7 in the completely assembled state.

FIG. 1*a* shows a patient 1 located on a transporting device 2 of the generic type—according to DE 38 06 470 C2—wherein the transporting device 2 assumes a first position. The transporting device 2 comprises an inner board 3 and an endless band 4 wrapped around this board 3. The weight of the patient is denoted by G. If the patient 1 or the endless band 4 is pulled with a force F toward the right, the transporting device 2 moves by the distance z to the right, while the patient 1 moves by the distance 2*z* toward the right. The second position of the transporting device 2 with the patient 1 is depicted in FIG. 1*b*.

Thus the patient 1 moves relative to a stationary base 5 and relative to the transporting device 2, the relative movement with respect to the base 5 being twice as large as the relative movement with respect to the transporting device 2. During these movements the endless band 4 slides over the inner board 3. For the force F, which is for example summoned by a nursing person, to be as low as possible, no large frictional forces must occur between the endless band 4 and the board 3.

In the case of frictionless deflection of the endless band 4 along the edges of the board 3 (for example by revolving or rolling) applies $$F=\mu G,$$

where μ is the coefficient of friction or friction factor. No differentiation is made here between the static (greater) and the kinetic (lesser) friction. Important for the invention is the kinetic friction. The kinetic friction becomes less, the greater the relative speed between superjacent bodies. In the following some examples of static and kinetic friction coefficients will be described (cf. Gross/Hauger/Schröder/Wall: Technische Mechanik 1, Statik, $9^{th}$ Edition, 2006, p. 252).

| | Static [Friction] Coefficient | [Kinetic] Friction Coefficient |
|---|---|---|
| Steel on ice | 0.03 | 0.015 |
| Steel on steel | 0.15 . . . 0.5 | 0.1 . . . 0.4 |
| Steel on Teflon | 0.04 | 0.04 |
| Leather on metal | 0.4 | 0.3 |
| Wood on wood | 0.5 | 0.3 |
| Car tires on streets | 0.7 . . . 0.9 | 0.5 . . . 0.8 |
| Ski on snow | 0.1 . . . 0.3 | 0.04 . . . 0.2 |

As can be seen in the above Table, when using Teflon a very low coefficient of friction is attained. In addition, in this case there is no difference between static friction and kinetic friction.

Although friction occurs on the top side as well as also on the underside of the board 3, no doubling of the frictional force results, since the force F travels the distance 2*z*, the band on the board 3, however, at every site travels only the relative distance z, referred in each case to a stationary base.

With friction-entailing deflection of the endless band 4 at the board ends, according to the rope friction laws (Euler-Eytelwein formula) the resulting force is $$F = \mu G + 2S_0 \frac{e^{\mu S \pi} - 1}{e^{\mu S \pi} + 1}$$

wherein $S_0$ is the prestress force and $\mu_S$ is the coefficient of friction at the deflection site.

If $\mu$=0.1 and $\mu_S$=0.1 is assumed, the resulting tensile force F is $$F = \left(0,1 + \frac{2}{20}\frac{e^{\pi/10} - 1}{e^{\pi/10} + 1}\right)G = 0,1 \cdot G(1 + 0,16)$$

Through the friction along the deflection sites, thus, the required tensile force increases by approximately 16% at the formulated numerical values. Overcoming the friction at the deflection sites would also be necessary even if the transporting device were to be displaced without a patient. The Euler-Eytelwein formula yields the magnitude of difference two forces acting at rope segment endpoints are allowed to assume before the rope wrapped about a round object starts to slip.

FIG. 2 shows the transporting device 2 in top view. Evident is the endless band 4 as well as at the sides one cap 6, 7 each with a handhold 8, 9. The caps 6, 7 are partially covered by the endless band 4, which is indicated by dashed lines. Stops, for example bolts, are denoted by 10, 11, 12, 13, which prevent the horizontal dislocation of the endless band 4. The rounding-over of the endless band 4 at the long sides is indicated by two parallel lines.

FIG. 3 shows the transporting device 2 once again in perspective view, one edge being cut open. At the cut-open site can be seen the inner board 3 as well as an optionally provided sheet 14 which is wrapped about the board 3 and fixedly connected therewith. The endless band 4, in turn, is wrapped about the sheet 14. In order to show the board 3 and the sheet 14, FIG. 3 does not show that the cap 7 is, in fact, located above the sheet 14, thus between sheet 14 and endless band 4.

A section A-A through the transporting device 2 according to FIG. 2 is depicted in FIG. 4. Herein can be seen the board 3, which is encompassed by sheet 14. This sheet 14, fixedly connected with board 3, is, in turn, encompassed by the endless band 4. Two stops 11 and 13 for the endless band 4 are evident on the right and left end of the transporting device 2. By 15 and 16 are denoted bolts which connect the caps 6, 7, not shown in FIG. 4, with the board 3. The bolts 15, 16 are double bolts, in which the external threading of the one bolt is screwed into an internally threaded bushing of the other bolt. Instead of two bolts, it is understood that three or more bolts can also be provided. It is important that when the sheet 14 is provided, it must have a very low coefficient of friction on its outside. The same applies to the inside of the endless band 4.

FIG. 5 shows a cap 6 with a handhold 8. The cap 6 has three regions: a lower region 18 and two upper regions 19, 20. The two upper regions 19, 20 are bridged by the handhold 8. In the lower region 18 are evident two holes 21, 22 which serve for receiving the bolts 15, 16. In the upper region 19 is evident a hole 23 which serves for receiving a stop 11, 13.

The cap 6 is placed over the board 3 with the sheet 14, such that the lower region 18 encompasses board 3 and sheet 14. The end of board 3 and sheet 14 abuts maximally up to a wall 24 of the lower region 18. When the ends of board 3 and sheet 14 are slid into the cap 6, the lower region 18 is connected with board 3 and sheet 14 by means of bolts which are inserted through the holes 21, 22. The endless band 4, not shown in FIG. 5, extends maximally only up to the lower edge of wall 24. If no sheet 14 is provided, the cap 6 is placed directly over the end of board 3.

FIG. 6 depicts a longitudinal section through cap 6, which shows the handhold 8 and the upper regions 19, 20 and the lower region 18. Beneath the handhold 8 is disposed a U-shaped web 25, which serves as a stop for the combination of board 3 and sheet 14 or only for board 3. As such a stop serve also the blocks 26, 27, which are provided with bores 28, 29 into which stops 11, 13 can engage.

FIG. 7 shows a variant of a transporting device 30, which, instead of one board, comprises two boards 33, 34. Caps 6, 7 with handholds 8, 9 as well as the endless band 4 are not yet mounted. The two boards 33, 34 have outer margin regions 40, 41 and inner margin regions 31, 32.

The boards 33, 34, which in FIG. 7 are not provided with a sheet corresponding to the sheet 14 according to FIG. 3, are at their inner margin regions 31, 32 connected with one another with a connection element not shown in FIG. 7. The endless band 4 is hereupon placed over both boards. Boards 33, 34 can also be provided with a sheet which is fixedly connected therewith. This sheet serves substantially for reducing the frictional forces.

FIG. 7*a* shows a connection element 38 with which the inner margin regions 31, 32 of boards 33, 34 are connected with one another. This connection element 38 includes two U-shaped parts 46, 47, into which the inner margin regions 31, 32, not shown in FIG. 7*a*, of boards 33, 34 are inserted and connected, for example using bolts, with parts 46, 47. For this purpose holes 60 to 63 are provided. The direction into which the inner margin region 32 is slid, is denoted by X. The two U-shaped parts 46, 47 are connected with one another via an elastic band 37.

If the two boards 33, 34 are placed one above the other, thus are oriented parallel to one another, the elastic band 37, which is comprised for example of rubber, assumes the position 37', while the U-shaped part 47 assumes the position 47'. In its folded state the transporting device can be transported more easily.

In FIG. 7*a* are shown some dimensions which, however, have only exemplary character.

FIG. 8 shows the variant of FIG. 7 once again in its partially assembled state and without connection element 38. It is evident that a single endless band 4 is slid over two separate boards 33, 34. In the interior of the transporting device 30 the margin regions 31, 32 of these boards 33, 34 oppose one another. If the caps 6, 7 are now placed over the margin regions 40, 41, the inner walls of their lower regions 18 are in contact on the outer margin regions 40, 41 of boards 33, 34, or on a sheet pulled thereover. Both boards 33, 34 are covered by the endless band 4. Thereby that approximately two thirds of the caps 6, 7 are covered by the endless band 4, is prevented that body fluids penetrate into the inner region of the transporting device or onto the inner sheets which encompass boards 33, 34. The caps 6, 7 partially located between the boards 33, 34 or the boards encompassed by a sheet, they fulfill a protective function. They are significantly easier to clean than the sheets or the boards or the endless band 4.

In FIG. 9 the completely assembled transporting device 30 is folded in the center such that two side pieces 44, 45 result which oppose one another. In the completely folded-over state the transporting device 30 can be more easily transported. The folding over is made possible through the means depicted in FIG. 7*a*.

As material for the inner board or for the inner boards is preferably utilized EPP (=Expanded Polypropylene). This material is very light-weight and, moreover, flexible. Depending on the size of the transporting device, a total weight of 1.3 to 2.5 kg results. Caps 6, 7 at the particular ends of the transporting device are preferably comprised of impact resistant polyethylene or ABS (=acrylonitrile butadiene styrene). The endless band 4 which can be comprised for example of Nylon, preferably includes on its outside a silver coating since silver has antibacterial properties. The silver layer can additionally be coated with an acryl layer.

The sheet 14 directly in contact on board 3 and fixedly connected with it is preferably comprised of polyethylene or polytetrafluoroethylene (PTFE), if indicated with fiber glass or carbon reinforcement. High Density Polypropylene (HDPE) or Low Density Polypropylene (LDPE) can also be utilized. The frictional force between the inside of the endless band 4 and the top side of the board or the top side of the sheet encompassing the board must be very low. If a sheet 14 is not provided, the board 3 is preferably coated with Teflon or silicon.

At the deflection edges, where an additional friction of, for example, 16% occurs, an additional coating with extremely low friction can be provided, such as, for example, a Teflon coating or an antifriction agent from the nanotechnology (Lotus effect). This coating can be applied directly on the board or optionally on the sheet 14.

It is understood, that for example the handholds 8, 9 can also be implemented differently, for example as loops.

The term "board" is employed in its most general meaning. Among these meanings can also be hollow synthetic structures which can be inflated. The sheet 14, which is fixedly connected with the board, thus does not slide over it, can be omitted if the outside of the board is coated with a layer which has a very low coefficient of friction, for example Teflon or silicon.

Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

I claim:

1. Transporting device (2) for patients (1), with 1.1. an endless band (4) which is wrapped about a board (3) and has at least on its inside a low coefficient of friction, 1.1.1 wherein the cross sectional circumference of the board (3) corresponds substantially to the cross sectional circumference of the endless band (4), characterized in that at the ends of the board (3) caps (6, 7) are provided which partially extend under the endless band (4).

2. Transporting device as claimed in claim 1, characterized in that the board (3) is comprised of a very light-weight and resiliently flexibly material and is encompassed by a sheet (14), which at least on its outside has a very low coefficient of friction and is fixedly connected with the board (3).

3. Transporting device as claimed in claim 2, characterized in that the very light-weight and resiliently flexible material is expanded polypropylene (=EPP=Expanded Polypropylene).

4. Transporting device as claimed in claim 1, characterized in that the caps (6, 7) are placed over nds of the board (3).

5. Transporting device as claimed in claim 1, characterized in that the caps (6, 7) are placed over the sheet (14).

6. Transporting device as claimed in claim 4, characterized in that on the caps (6, 7) handholds (8, 9) are provided.

7. Transporting device as claimed in claim 6, characterized in that the handholds (8, 9) are rigid and formed in the shape of a U.

8. Transporting device as claimed in claim 6, characterized in that the handholds are loops.

9. Transporting device as claimed in claim 2, characterized in that the caps (6, 7) are connected with the board (3) by means of bolts (15, 16), wherein the bolts (15, 16) penetrate through the entire board (3).

10. Transporting device as claimed in claim 1, characterized in that it is foldable at the center.

11. Transporting device as claimed in claim 1, characterized in that the caps (6, 7) have two halves (19, 20), which are bridged by a handhold bridge (8).

12. Transporting device as claimed in claim 1, characterized in that the caps (6, 7) are comprised of impact resistant polyethylene.

13. Transporting device as claimed in claim 1, characterized in that the caps (6, 7) are comprised of ABS (=acrylonitrile butadiene styrene).

14. Transporting device as claimed in claim 2, characterized in that the outside of the sheet (14) is coated with Teflon or silicon.

15. Transporting device as claimed in claim 1, characterized in that the endless band (4) includes at least on its outside silver.

16. Transporting device as claimed in claim 1, characterized in that the board is comprised of two parts (33, 34) which are connected with one another via a connection element (38).

17. Transporting device as claimed in claim 16, characterized in that the connection element (38) includes two U-shaped parts (46, 47) and an elastic band (37).

* * * * *